US007891895B2

(12) United States Patent
Myers

(10) Patent No.: US 7,891,895 B2
(45) **Date of Patent: *Feb. 22, 2011**

(54) RECEIPT PRINTER CONFIGURABLE FOR FULL OR PARTIAL CUT

(75) Inventor: Robert Andrew Myers, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 27 days.

This patent is subject to a terminal disclaimer.

(21) Appl. No.: 12/020,845

(22) Filed: Jan. 28, 2008

(65) Prior Publication Data

US 2008/0118296 A1 May 22, 2008

Related U.S. Application Data

(62) Division of application No. 10/987,838, filed on Nov. 12, 2004.

(51) Int. Cl.
*B41J 11/70* (2006.01)

(52) U.S. Cl. ..... 400/621; 83/51; 83/694; 83/608

(58) Field of Classification Search ..... 83/608
See application file for complete search history.

(56) References Cited

U.S. PATENT DOCUMENTS

| | | | | |
|---|---|---|---|---|
| 4,699,609 | A | 10/1987 | Komaransky et al. | |
| 4,981,059 | A | 1/1991 | Kobayashi | |
| 5,174,670 | A | 12/1992 | Takagi et al. | |
| 5,505,552 | A | 4/1996 | Hasegawa et al. | |
| 5,531,530 | A | 7/1996 | Kuramoto et al. | |
| 5,833,380 | A | 11/1998 | Hosomi et al. | |
| 5,957,597 | A | 9/1999 | Kato | |
| 6,302,605 | B1 | 10/2001 | Kanbe | |
| 6,347,896 | B1 * | 2/2002 | Robinson | 400/621 |
| 6,405,625 | B1 | 6/2002 | Nomura et al. | |
| 6,408,727 | B1 * | 6/2002 | Harris et al. | 83/566 |
| 6,443,645 | B1 | 9/2002 | Takei et al. | |
| 6,447,187 | B1 | 9/2002 | Robinson | |
| 6,814,516 | B2 * | 11/2004 | Tsuchiya et al. | 400/621 |
| 7,059,793 | B2 * | 6/2006 | Mori et al. | 400/621 |
| 2003/0172792 | A1 | 9/2003 | Imai | |

FOREIGN PATENT DOCUMENTS

| | | | |
|---|---|---|---|
| JP | 06079934 | A * | 3/1994 |
| JP | 10193712 | A * | 7/1998 |
| JP | 10337920 | A * | 12/1998 |
| JP | 2001030559 | A * | 2/2001 |

OTHER PUBLICATIONS

"Adjustable-Width Paper Guillotine Mechanism," Jun. 1, 1986, IBM TDB, vol. 29, Iss. 1, pp. 53-54.*

* cited by examiner

*Primary Examiner*—Daniel J Colilla
(74) *Attorney, Agent, or Firm*—Dillon & Yudell LLP

(57) ABSTRACT

A receipt printer having a scissor cutter for cutting off a receipt from a paper roll. The scissor cutter includes a moving blade that articulates across an adjustable stationary blade. The adjustable stationary blade is adjustable laterally according to whether a full cut or a partial cut across the paper roll is desired. If a full cut is desired, the stationary blade is positioned against the full width of the paper roll. If a partial cut is desired, the stationary blade is positioned against only a portion of the width of the paper roll.

19 Claims, 7 Drawing Sheets

RECEIPT PRINTER CONFIGURABLE FOR FULL OR PARTIAL CUT

PRIORITY CLAIM

The present application is a divisional of U.S. patent application Ser. No. 10/987,838, filed on Nov. 12, 2004, and entitled, "Receipt Printer Configurable for Full or Partial Cut," which is incorporated herein by reference.

BACKGROUND OF THE INVENTION

1. Technical Field

The present invention relates in general to the field of printers, and in particular to paper tape receipt printers. Still more particularly, the present invention relates to a receipt printer having a scissor cutter that is adjustable to create either a full or partial cut across paper tape.

2. Description of the Related Art

Point-Of-Sale (POS) receipt printers typically use roll paper on which sales receipts are printed. After being printed, the sales receipt is separated from the rest of the paper roll by either an automatic cutter or a manual tear bar. With most automatic cutters, the receipt is not cut across the entire width of the paper roll. Rather, a small length of uncut paper is left so that the paper does not fall out of the printer and onto the counter or floor. The uncut portion of the paper is then torn by hand, and the receipt is handed to the customer. Alternatively, there are some applications where a full cut is desired, such that a smooth edge is provided across the entire bottom edge of the receipt, and for situations in which multiple receipts must be neatly stacked after exiting the printer.

It is often desired that a same printer be able to produce either a fully cut or a partially cut paper receipt. This is accomplished in various ways in the prior art. For example, U.S. Pat. No. 4,981,059, issued Jan. 1, 1991 to Kobayashi, and U.S. Pat. No. 6,302,605 B1, issued Oct. 16, 2001 to Kanbe, teach the use of a rotary cutter, which is a small wheel that rolls along a grooved support, which can vary the cut length by stopping the wheel in different locations. Alternatively, U.S. Pat. No. 5,505,552, issued Apr. 9, 1996 to Hasegawa et al, teaches the use of a guillotine cutter that advances a guillotine blade to a first position to produce a partial cut, or advances to a second position to produce a full cut.

A system that uses an adjustable scissor cutter is described in U.S. Pat. No. 6,347,896 B1, issued Feb. 19, 2002 to Robinson. This system teaches the use of a fixed blade that is mounted to a fixed chassis. A moving blade, that articulates across a cutting edge of the fixed blade, is adjustable, such that repositioning a cutting tip of the moving blade defines the length of the cut across the paper tape. However, this arrangement requires a complex system of slots and crank pins to reposition the moving blade, which makes the system susceptible to misalignment and mechanical jamming.

What is needed, therefore, is an improved system for adjusting the cutting width of a scissor cutter across a paper roll. Preferably, such a system would be easily adjusted with minimal impact on operational moving components.

SUMMARY OF THE INVENTION

The present invention is thus directed to a receipt printer having a scissor cutter for cutting off a receipt from a paper roll. The scissor cutter includes a moving blade that articulates across an adjustable stationary blade. The adjustable stationary blade is adjustable laterally according to whether a full cut or a partial cut across the paper roll is desired. If a full cut is desired, the stationary blade is positioned against the full width of the paper roll. If a partial cut is desired, the stationary blade is positioned against only a portion of the width of the paper roll.

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE PREFERRED EMBODIMENT

Figure 1A:
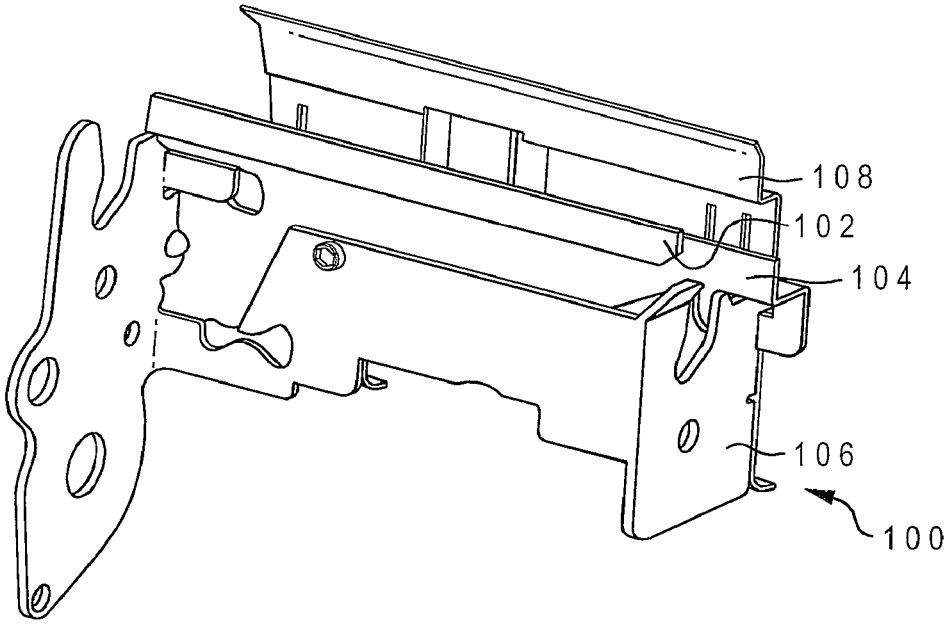
FIGS. 1*a-e* depict an inventive scissor cutter having an adjustable stationary blade positioned for a partial cut of a paper tape.

With reference now to the figures, and particularly to FIG. 1*a*, there is depicted a front view of a scissor cutter 100. In a preferred embodiment, scissor cutter 100 is mounted in a receipt printer (not shown) that prints Point-Of-Sale (POS) receipts onto a paper roll.

Scissor cutter 100 includes an adjustable stationary blade 102. While the term "adjustable stationary" may at first appear to be an oxymoron, "adjustable stationary" accurately describes stationary blade 102 as being "stationary" (not moving) during a cutting operation, while being "adjustable" (capable of being moved laterally) to enable either a full or partial cut across a paper roll, as described in detail below.

Stationary blade 102 is mounted on a blade carrier 104, which is slidably coupled to a printer mount 106, which is mounted in a receipt printer (not shown). Mounted to the back of blade carrier 104 is a tear bar 108, shown in further detail in the rear view of scissor cutter 100 depicted in FIG. 1*b*.

Figure 1B:
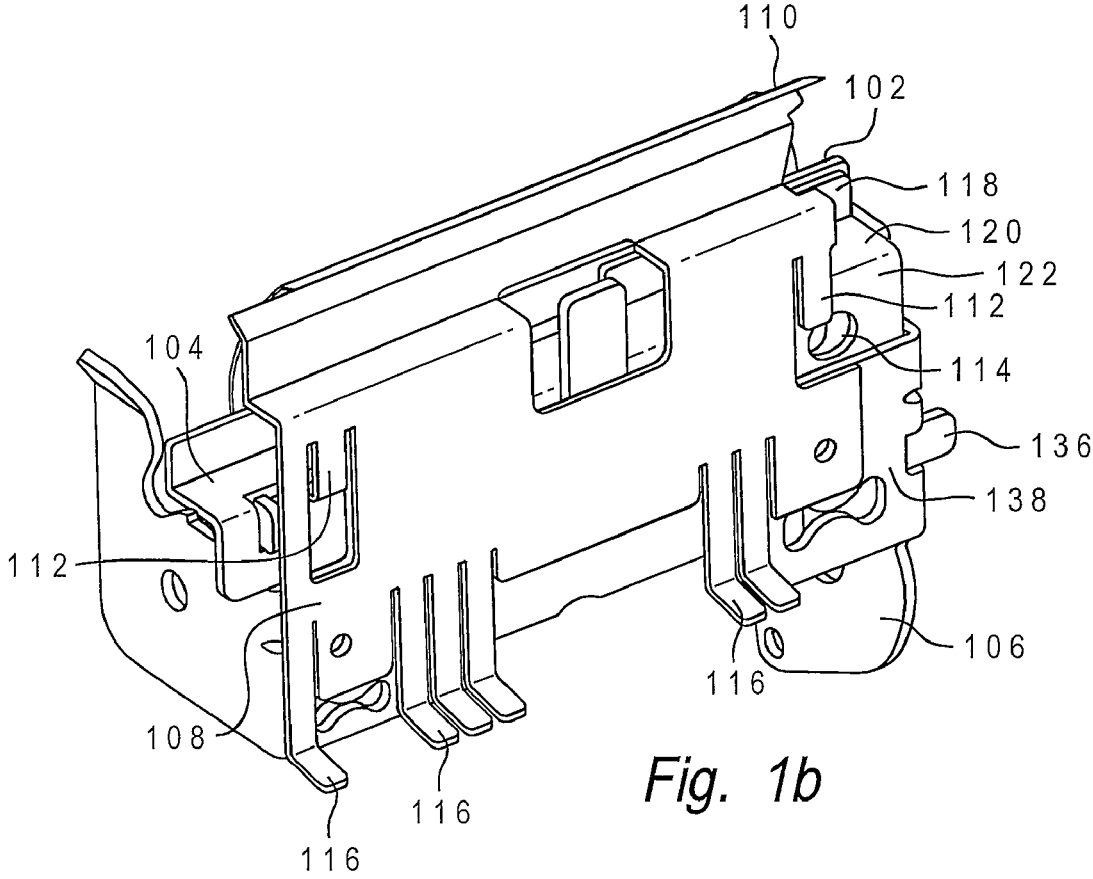
Figure 1C:
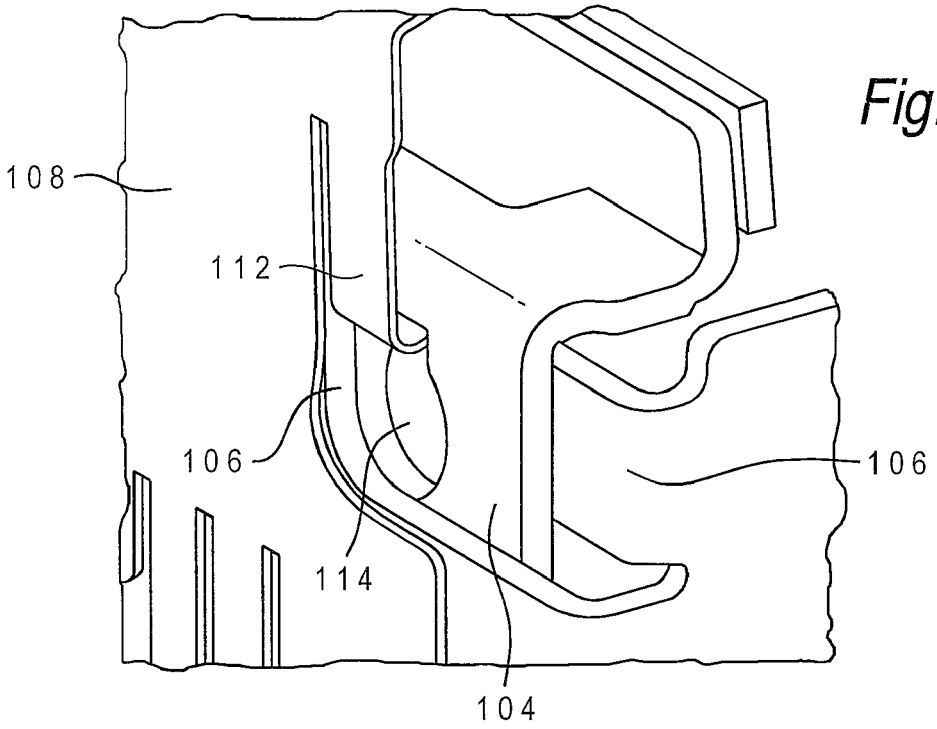

As seen in FIG. 1*b*, tear bar 108 has a tear edge 110, whose function is discussed below. As shown in detail in FIG. 1*c*, tear bar 108 also has coupling tabs 112 that couple snugly into carrier holes 114, thus allowing tear bar 108 to move blade carrier 104 laterally to printer mount 106. To provide an electrical grounding function, tear bar 108 has lower lips 116 (shown in FIG. 1*b*) that mate against an interior surface of the receipt printer (not shown) in which scissor cutter 100 is mounted. Undue pivoting prevention and general alignment is afforded by a retention slot tab 136 that slides within a retention slot 138.

While blade carrier 104 and tear bar 108 are described as being mounted together in a fixed relationship, in an alternate preferred embodiment tear bar 108 is fixed to the frame of printer mount 106, and thus does not move with stationary blade 102.

With reference still to FIG. 1*b*, blade carrier 104 preferably is Z-shaped. The Z-shape has three perpendicular (normal to each other) sections: a stationary blade mounting section 118, a transition section 120, and a friction locking section 122.

Figure 1D:
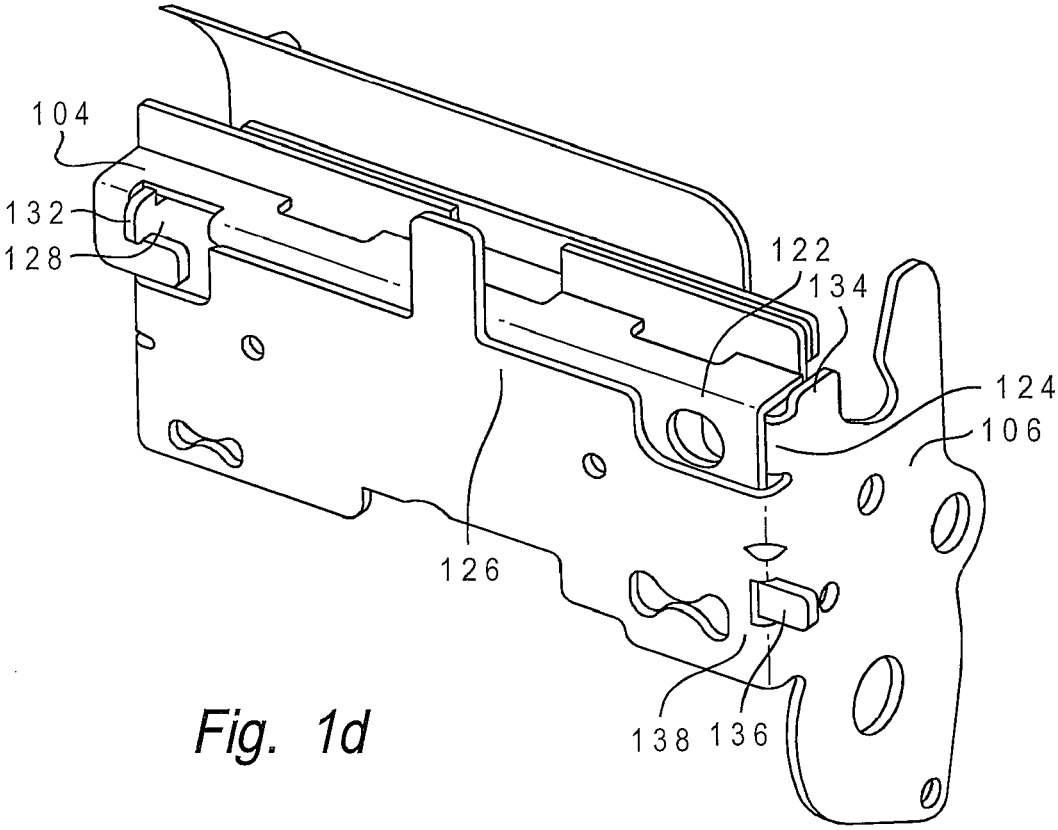

Stationary blade mounting section 118 mounts stationary blade 102, as shown in the figures. Transition section 120 couples stationary blade mounting section 118 to friction locking section 122, and supports stationary blade mounting section 118. Friction locking section 122 provides friction resistant lateral movement of blade carrier 104 within an open channel in printer mount 106. As shown in FIG. 1*d* (with tear bar 108 removed for clarity of illustration), this open channel is a space in printer mount 106 that is formed by a first end retention tab 124, a back plate 126, and a second end retention slot 128 in printer mount 106. That is, friction locking section 122 slides against first end retention tab 124 and back plate 126, while, as shown in detail in FIG. 1*e*, a retention slot tab 130 slides within the second end retention slot 128.

Figure 1E:
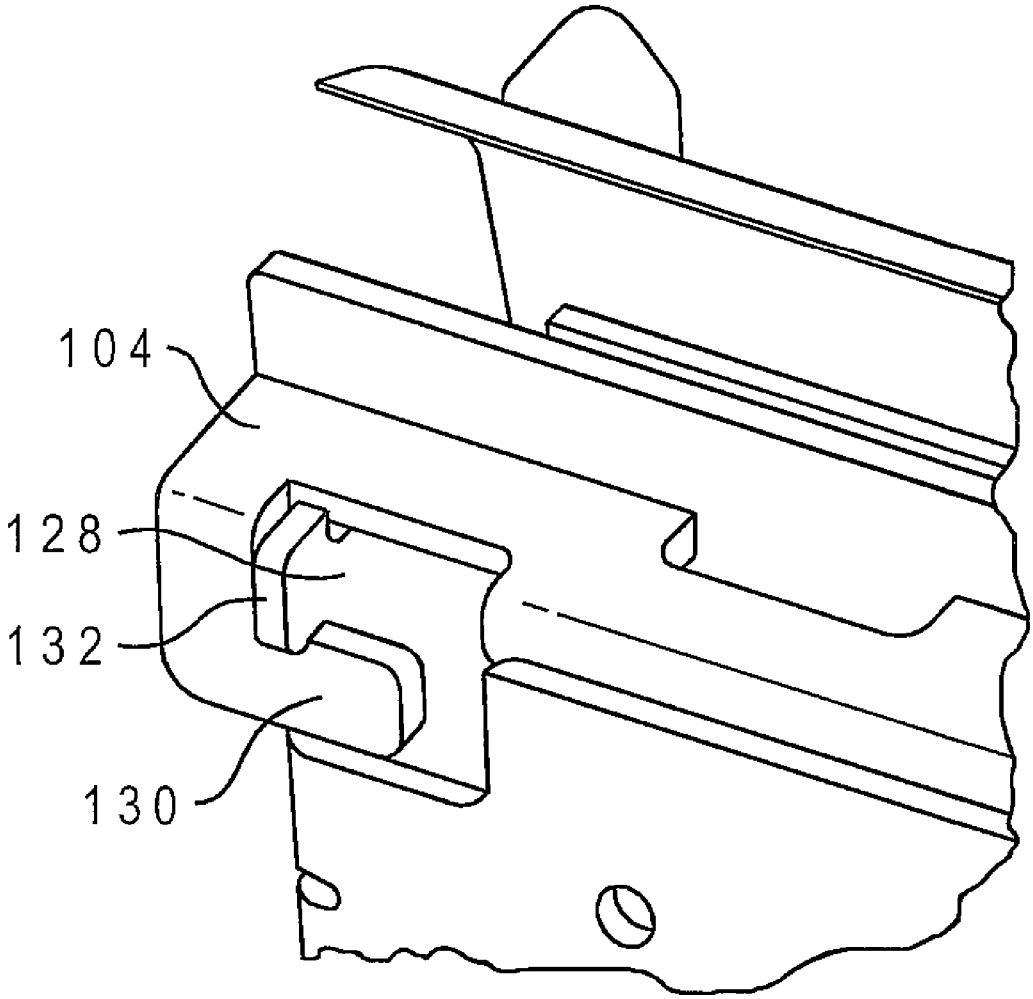

Note that, as shown in FIGS. 1*d-e*, lateral movement of blade carrier 104 is stopped at the partial cut position by one end of blade carrier 104 hitting a printer mount tab 124 (FIG. 1*d*) and a cut-out 128 at the other end of blade carrier 104 hitting an outer side of a printer mount stop 132 (FIG. 1*e*). Similarly, as shown in FIG. 1*e* and FIG. 2*c*, lateral movement of blade carrier 104 is stopped at the full cut position by coupling tab 112 hitting printer mount 106 while the cut-out 128 at the other end of blade carrier 104 hits and inner side of printer mount stop 132.

Note that whether adjustable stationary blade 102 is in the full cut position or the partial cut position, rotational movement of blade carrier 104 is prevented by a retention slot tab 136 from blade carrier 104 being slid within a retention slot 138 of printer mount 106.

Figure 2A:
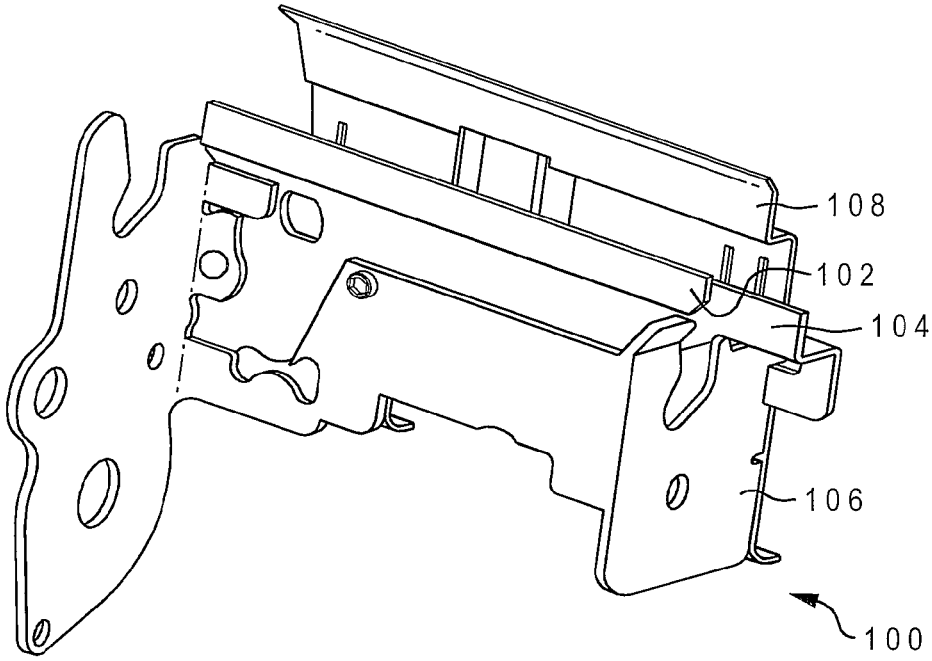
FIGS. 2*a-c* illustrate the scissor cutter positioned for a full cut of the paper tape.
Figure 2B:
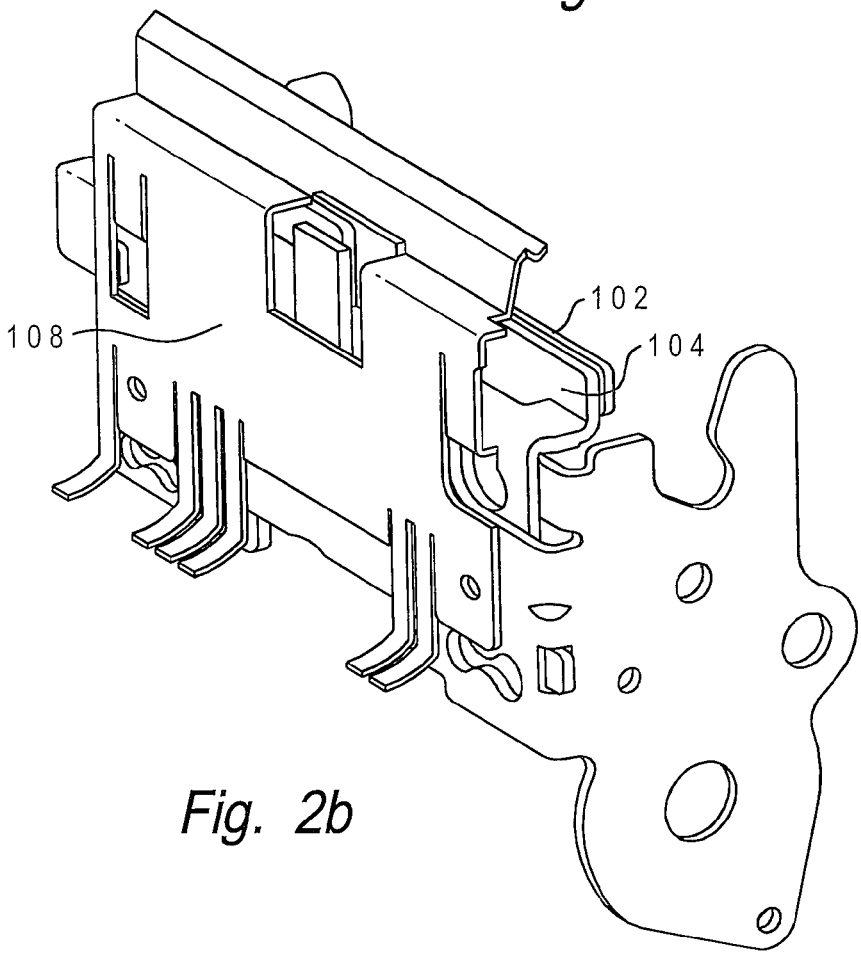
Figure 2C:
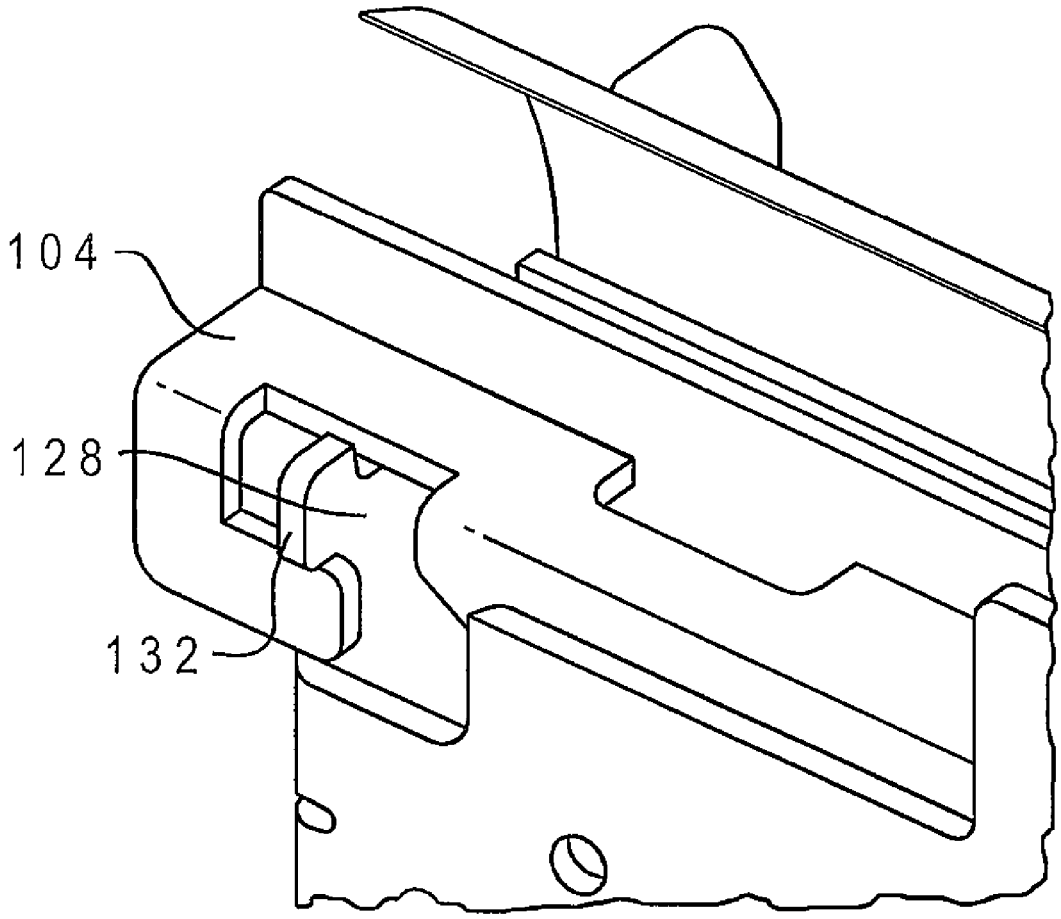

While FIG. 1*a* shows adjustable stationary blade 102 positioned for a partial cut of paper tape, FIG. 2*a* shows details of the same scissor cutter 100 having adjustable stationary blade 102 positioned for a full cut of paper tape. Thus, as shown in FIG. 2*a*, blade carrier 104 is positioned to the right relative to how it was positioned in FIG. 1*a*. Additional detail of blade carrier 104 positioned for a full cut is shown in a rear view in FIGS. 2*b-c*.

Figure 3A:
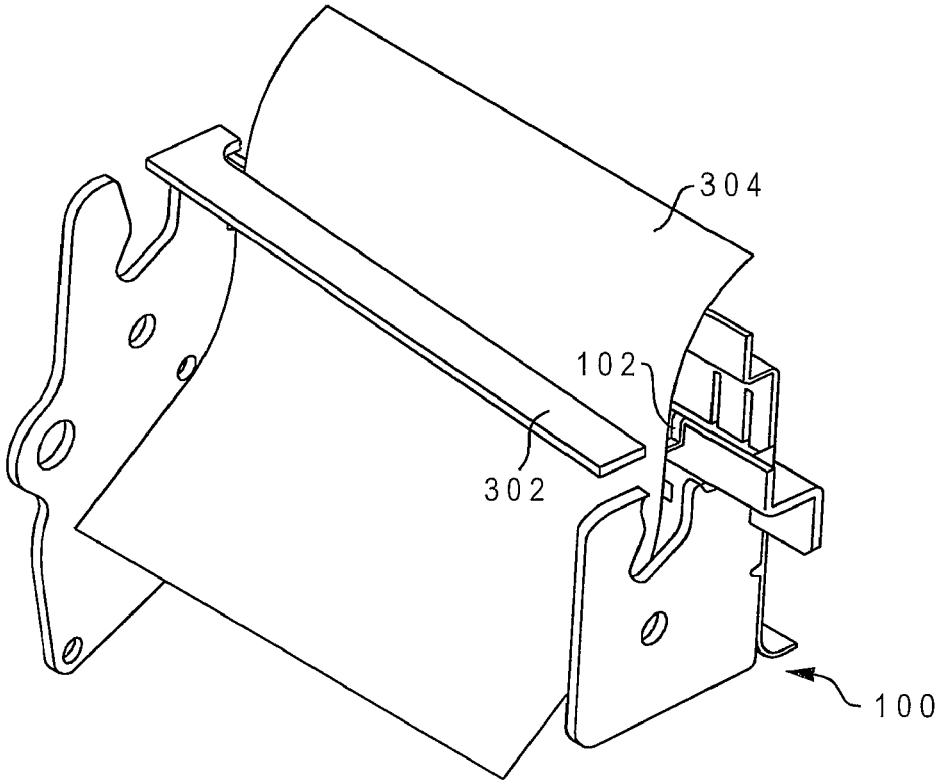
FIGS. 3*a-b* depict the scissor cutter cutting a full cut across the paper tape.
Figure 3B:
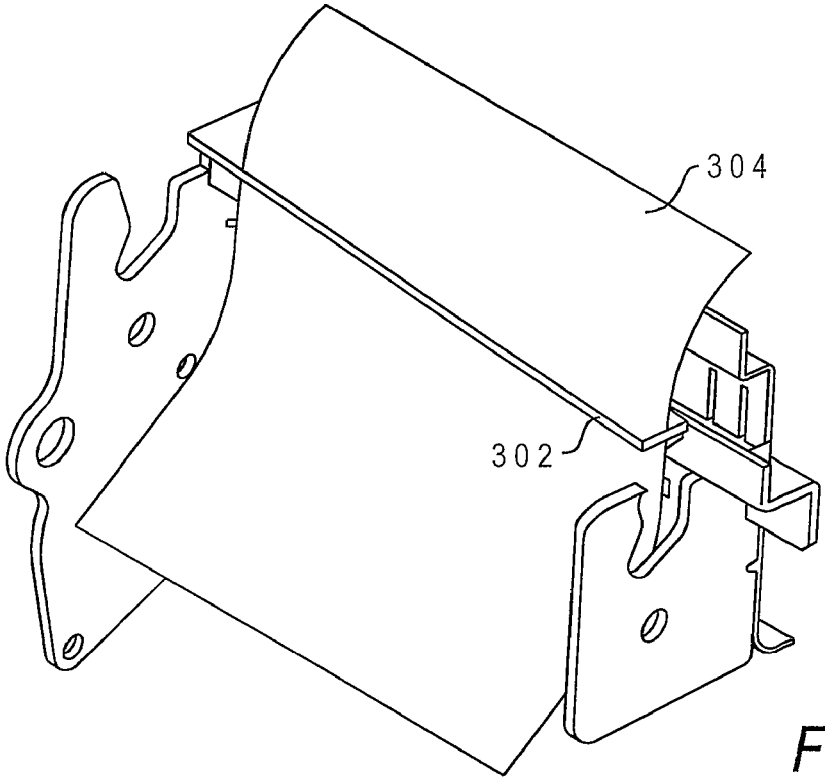

With reference now to FIGS. 3*a-b*, a moving blade 302 is shown relative to adjustable stationary blade 102. In FIG. 3*a*, paper from a paper roll 304 is positioned between moving blade 302 and adjustable stationary blade 102. Moving blade 302 is mounted to a chassis (not shown) that permits a cutting edge on moving blade 302 to engage against a corresponding cutting edge on adjustable stationary blade 102 in a scissor-like manner. Note that, as illustrated, adjustable stationary blade 102 is positioned for a full cut across paper roll 304, since the entire width of paper roll 304 is positioned against adjustable stationary blade 102. In FIG. 3*b*, moving blade 302 has been moved to a second position that resulted in paper roll 304 being cut between moving blade 302 and adjustable stationary blade 102. After making the cut, moving blade 302 is pulled back to the first position shown in FIG. 3*a*.

To make a partial cut across paper roll 304, adjustable stationary blade 102 is repositioned (to the left, when viewing FIG. 3*a*), such that only a portion of the width of paper roll 304 is against adjustable stationary blade 102. Thus, in the partial cut position, adjustable stationary blade 102 only cuts part of paper roll 304, leaving an uncut portion (preferably 3-5 mm) at the right edge of paper roll 304.

As noted above, one function of tear bar 108 is to provide a "handle" to move adjustable stationary blade 102, such as when tear bar 108 protrudes above a lid (not shown) on a closed receipt printer. However, tear bar 108 is also able to provide a traditional tear cut across paper roll 304 without using scissor cutter 100.

Figure 4:
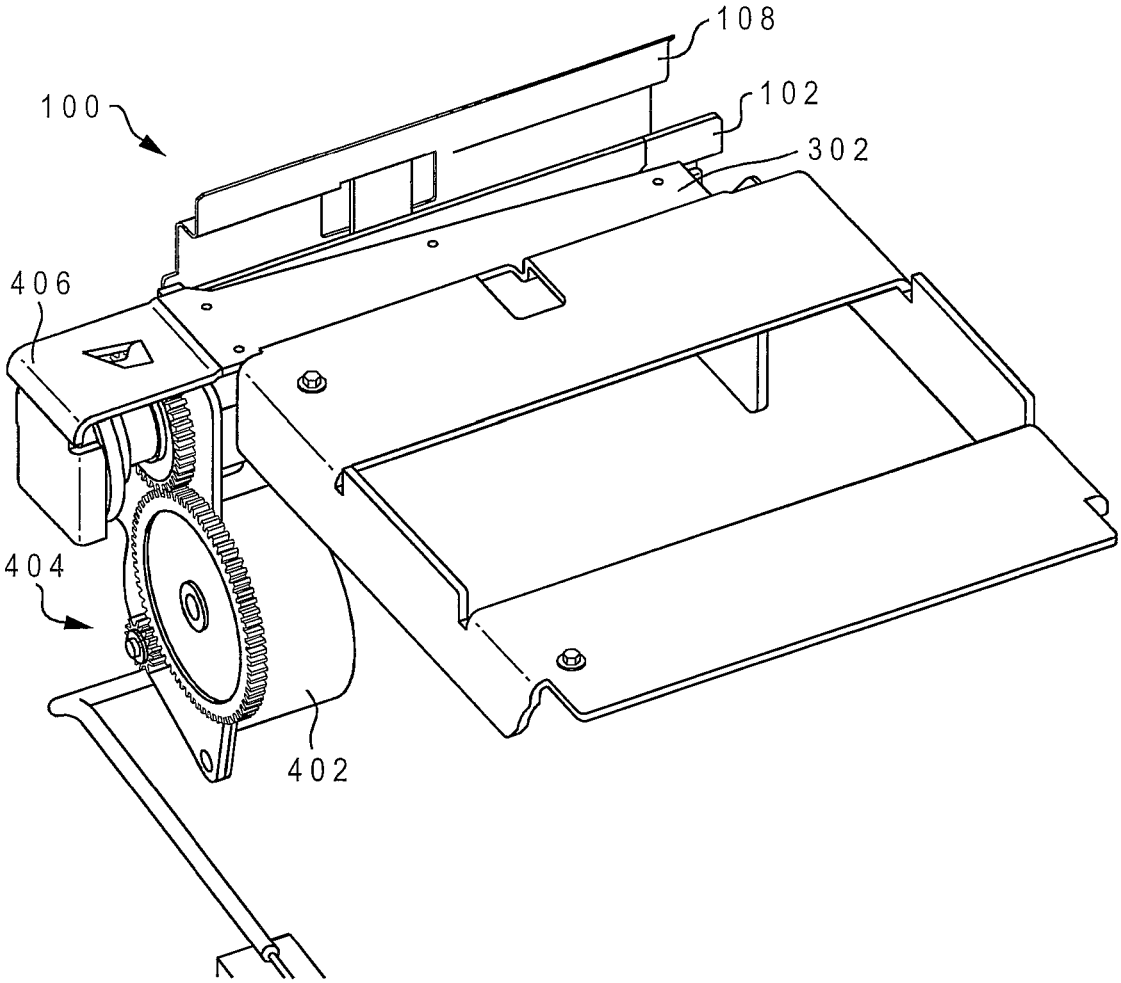
FIG. 4 illustrates a moving blade positioned against the adjustable stationary blade.

With reference now to FIG. 4, scissor cutter 100 is depicted (shown without a supporting frame for purposes of clarity). Scissor cutter 100 includes tear bar 108, adjustable stationary blade 102, and moving blade 302. A motor 402 turns gears 404, which cause moving blade 302 to pivot about a pivot point 406, thus causing moving blade 302 to slice against adjustable stationary blade 102 as shown (in a "cut completed" position).

While the invention has been particularly shown and described with reference to a preferred embodiment, it will be understood by those skilled in the art that various changes in form and detail may be made therein without departing from the spirit and scope of the invention.

What is claimed is:

1. A paper tape printer comprising:

a receipt printer that prints receipts on a paper tape; and a scissor cutter comprising:

a moving blade mounted to a chassis and having a fixed range of motion around a pivot point;

an adjustable stationary blade, wherein the adjustable stationary blade is moveable laterally relative to and independent of the moving blade to allow the paper tape to be selectively fully or partially cut, wherein the paper tape is only partially cut when the stationary blade is positioned in a first lateral position by laterally adjusting the position of the adjustable stationary blade to the first lateral position when the stationary blade is not in the first lateral position and the paper tape is fully cut when the stationary blade is positioned in a second lateral position by laterally adjusting the position of the adjustable stationary blade to the second lateral position when the adjustable stationary blade is in the first lateral position;

wherein only a portion of a width of the paper tape is against the adjustable stationary blade when the adjustable stationary blade is in the partial cut position and an entire width of the paper tape is against the adjustable stationary blade when the adjustable stationary blade is in the full cut position; and a blade carrier to which the adjustable stationary blade is mounted.

2. The paper tape printer of claim 1, wherein the receipts are Point-Of-Sale (POS) receipts.

3. The paper tape printer of claim 1, further comprising:

a tear bar that is mounted to a back of the blade carrier; and lower lips connected to the tear bar, wherein the lower lips mate against an interior surface of the paper tape printer to provide an electrical grounding of the tear bar.

4. The paper tape printer of claim 3, wherein:

the tear bar comprises coupling tabs that couple snugly into carrier holes to allow the tear bar to move the blade carrier laterally to the printer mount; and a retention slot tab slides within a retention slot to prevent undue pivoting and general alignment and prevent rotational movement of the blade carrier.

5. The paper tape printer of claim 3, wherein the tear bar and the blade carrier are mounted together in a fixed relationship.

6. The paper tape printer of claim 3, wherein the tear bar is fixed to a frame of a printer mount in the paper tape printer, and wherein the tear bar does not move with the adjustable stationary blade.

7. The paper tape printer of claim 1, wherein:

the movable blade is not connected to the adjustable stationary blade and the movable blade articulates across the adjustable stationary blade;

the lateral movement of the adjustable stationary blade along the blade carrier does not provide any lateral movement to the movable blade; and when the adjustable stationary blade is moved laterally relative to the moving blade to partially cut the paper tape, an uncut portion of the paper tape is left intact.

8. A paper tape printer comprising:

a receipt printer that prints receipts on a paper tape; and a scissor cutter comprising:

a moving blade having a fixed range of motion;

an adjustable stationary blade, wherein the adjustable stationary blade is moveable laterally relative to the moving blade to allow the paper tape to be selectively fully or partially cut, wherein the paper tape is only partially cut when the stationary blade is positioned in a first lateral position and the paper tape is fully cut when the stationary blade is positioned in a second lateral position;

a blade carrier to which the adjustable blade is mounted, wherein the blade carrier is Z-shaped, and wherein the blade carrier includes:

a blade mounting section at a first end of the Z-shaped blade carrier;

a friction locking section at a second end of the Z-shaped blade carrier; and a transition section between the first and second ends of the Z-shaped blade carrier, wherein the first end of the Z-shaped blade carrier is normal to the transition section of the Z-shaped blade carrier, and wherein the second end of the Z-shaped blade carrier is normal to the transition section of the Z-shaped blade carrier.

9. The paper tape printer of claim 8, further comprising:

a tear bar that is mounted to a back of the blade carrier; and lower lips connected to the tear bar, wherein the lower lips mate against an interior surface of the paper tape printer to provide an electrical grounding of the tear bar.

10. The paper tape printer of claim 9, wherein:

the tear bar comprises coupling tabs that couple snugly into carrier holes to allow the tear bar to move the blade carrier laterally to the printer mount; and a retention slot tab slides within a retention slot to prevent undue pivoting and general alignment and prevent rotational movement of the blade carrier.

11. The paper tape printer of claim 9, wherein the tear bar and the blade carrier are mounted together in a fixed relationship.

12. The paper tape printer of claim 9, wherein the tear bar is fixed to a frame of a printer mount in the paper tape printer, and wherein the tear bar does not move with the adjustable stationary blade.

13. The paper tape printer of claim 8, wherein:

the movable blade is not connected to the adjustable stationary blade and the movable blade articulates across the adjustable stationary blade;

the lateral movement of the adjustable stationary blade along the blade carrier does not provide any lateral movement to the movable blade; and when the adjustable stationary blade is moved laterally relative to the moving blade to partially cut the paper tape, an uncut portion of the paper tape is left intact.

14. A paper tape printer comprising:

a receipt printer that prints receipts on a paper tape; and a scissor cutter comprising:

a moving blade mounted to a chasis and having a fixed range of motion around a pivot point;

an adjustable stationary blade, wherein the adjustable stationary blade is moveable laterally relative to and independent of the moving blade to allow the paper tape to be selectively fully or partially cut, wherein the paper tape is only partially cut when the stationary blade is positioned in a first lateral position and the paper tape is fully cut when the stationary blade is positioned in a second lateral position;

wherein only a portion of a width of the paper tape is against the adjustable stationary blade when the adjustable stationary blade is in a partial cut position and an entire width of the paper tape is against the adjustable stationary blade when the adjustable stationary blade is in a full cut position;

a blade carrier to which the adjustable stationary blade is mounted, wherein lateral travel of the blade carrier is limited by stops on a printer mount to which the blade carrier is slidably mounted.

15. The paper tape printer of claim 14, further comprising:

a tear bar that is mounted to a back of the blade carrier; and lower lips connected to the tear bar, wherein the lower lips mate against an interior surface of the paper tape printer to provide an electrical grounding of the tear bar.

16. The paper tape printer of claim 15, further comprising:

the tear bar comprises coupling tabs that couple snugly into carrier holes to allow the tear bar to move the blade carrier laterally to the printer mount; and a retention slot tab slides within a retention slot to prevent undue pivoting and general alignment and prevent rotational movement of the blade carrier.

17. The paper tape printer of claim 15, wherein the tear bar and the blade carrier are mounted together in a fixed relationship.

18. The paper tape printer of claim 15, wherein the tear bar is fixed to a frame of a printer mount in the paper tape printer, and wherein the tear bar does not move with the adjustable stationary blade.

19. The paper tape printer of claim 14, wherein:

the movable blade is not connected to the adjustable stationary blade and the movable blade articulates across the adjustable stationary blade;

the lateral movement of the adjustable stationary blade along the blade carrier does not provide any lateral movement to the movable blade; and when the adjustable stationary blade is moved laterally relative to the moving blade to partially cut the paper tape, an uncut portion of the paper tape is left intact.

* * * * *